US005131809A

United States Patent [19]

Gesenhues et al.

[11] Patent Number: 5,131,809

[45] Date of Patent: Jul. 21, 1992

[54] COOLING WATER PUMP

[75] Inventors: Bernhard Gesenhues, Birkenau; Detlef Cordts, Mörlenbach, both of Fed. Rep. of Germany

[73] Assignee: Firma Carl Freudenberg, Weinheim an der Bergstrasse, Fed. Rep. of Germany

[21] Appl. No.: 717,545

[22] Filed: Jun. 19, 1991

[30] Foreign Application Priority Data

Jul. 7, 1990 [DE] Fed. Rep. of Germany ..... 4021716

[51] Int. Cl.[5] ..... F01D 25/32

[52] U.S. Cl. ..... 415/168.2

[58] Field of Search ..... 415/168.1, 168.2, 169.1, 415/170.1, 174.2; 417/362, 364

[56] References Cited

U.S. PATENT DOCUMENTS 1,520,939 12/1924 Dorer ..... 415/168.2
4,869,649 9/1989 Hattori et al. ..... 417/364

FOREIGN PATENT DOCUMENTS 2846950 5/1979 Fed. Rep. of Germany ... 415/168.2
3821352 11/1989 Fed. Rep. of Germany .
150596 9/1987 Japan ..... 415/168.2
1359380 7/1974 United Kingdom .

*Primary Examiner*—John T. Kwon
*Attorney, Agent, or Firm*—Felfe & Lynch

[57] ABSTRACT

A cooling water pump for combustion engines has, between a sealing element 6 and a bearing 5, an annular chamber 7 provided with at least two openings 8, 9 penetrating the cover 2 of the bearing on opposing sides of the shaft 4. At least one absorbent disc 10 is provided axially between the ventilating openings 8, 9 and the bearing 5.

12 Claims, 1 Drawing Sheet

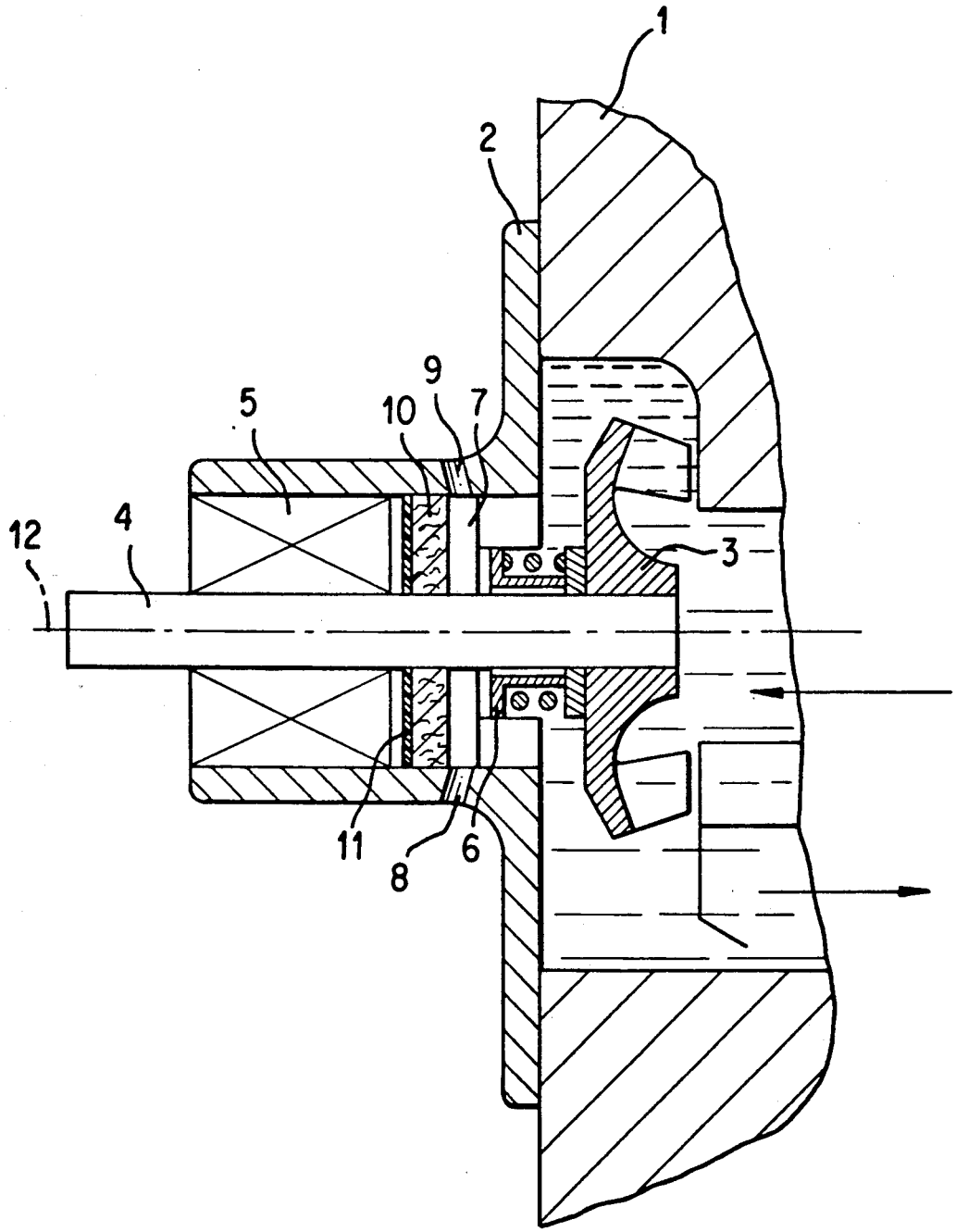
1
2
9
5
10
7
12
4
3
11
8
6

COOLING WATER PUMP

BACKGROUND OF THE INVENTION

The invention concerns a cooling water pump for combustion engines having a bearing cover which can be affixed to a housing in which a shaft having an impeller is rotatably supported by means of a bearing. A sealing element disposed in the interstice between impeller and bearing seals the cover with respect to the shaft. In the remaining interstice between bearing and sealing element, provision is made for an annular chamber having a ventilating device.

A cooling water pump of this type is known from German patent DE 38 21 352. The annular chamber with the ventilating device is provided to remove leakage liquid and keep this liquid away from the bearing.

SUMMARY OF THE INVENTION

The invention is based on the task of reducing the axial length of the annular ventilating chamber.

In the cooling water pump of the invention, at least two ventilating openings penetrate the cover on opposing sides of the shaft between the bearing and the sealing element. In the interstice, axially between the ventilating openings and the bearing, there is at least one absorbent ring which surrounds the shaft and seals it. Coolant which passes the sealing gap and flows along the shaft is temporarily absorbed by the ring. On the side of the ring which faces the sealing element, there is continuous evaporation, with the vapor being removed via the ventilating openings. For the coolant to be temporarily stored in the sealing element, it is not absolutely necessary that the sealing element contact the shaft. It is also possible to provide a space of capillary-active narrowness between these parts. Friction and wear can thus be reduced. With respect to the evaporation of the coolant, the relatively high temperature of pump shaft and sealing element, and the pumping action resulting from pump shaft rotation, are of considerable significance.

In addition, the ring can be associated with the shaft in a sealed relation which means either direct contact or close approach. In such an embodiment, the annular chamber is completely covered in the radial direction. This is a substantial improvement of the protection for the bearing against leakage liquid and of the protection for the sealing against over flowing lubricant from the bearing.

The ring can be concentrically fixed to the shaft or the bearing. An embodiment where the ring is concentrically fixed to the cover is preferred.

In order to prevent moisture from penetrating the ring in direction toward the bearing, it has proven advantageous to cover the side of the ring which faces the bearing with a liquid-impermeable layer. The latter can, for example, consist of a polymeric coating affixed in a liquid state. The use of an annular disk made of a liquid-impermeable material, for example metal or plastic, and manufactured independently of the ring, can, however, also be considered. This facilitates the concentric attachment of the ring at the bearing provided the inner and outer circumference are correspondingly calibrated. Generally, the ring has a tubular portion and a radial portion presenting a rectangular profile with L-shaped cross-sections. Embodiments of an angular profile can be more readily associated with the pump shaft and the housing with the necessary precision. The surface is relatively enlarged which promotes the evaporation of the coolant.

Under regular operating conditions, the air throughput across the annular chamber is supported by convection provided at least one opening is disposed above and at least one opening is disposed below the axis around which the shaft is rotated. Advantageously, at least one of these openings should be provided at the top and at least one at the bottom of the annular chamber. An additional advantage hereof is that coolant is prevented from collecting in the annular chamber.

The ring can be made of an open-pore foam, polyurethane, for example. As compared thereto, a ring made of a strong fibrous material, a matted material, for example, or nonwoven fabric, woven fabric or knit fabric has a substantially greater mechanical and chemical strength. The fibers used can be freely selected and may include those of natural, mineral or synthetic origin.

BRIEF DESCRIPTION OF THE DRAWING

The sole figure is a longitudinal cross section of the inventive pump.

DETAILED DESCRIPTION OF THE PREFERRED EMBODIMENT

The cooling water pump for a combustion engine includes a bearing cover 2 to be fastened to a housing 1 of a pump and a pump shaft 4 having an impeller 3 rotatably disposed in the housing by means of a bearing 5. A sealing element seals the cover 2 of the bearing with respect to the pump shaft 4. This sealing element is disposed in the interstice between the impeller 3 and the bearing 5 with an annular chamber 7, which has a ventilating device, being provided in the axial interstice or annular chamber between the bearing 5 and the sealing element 6. In the represented embodiment, the sealing element is a slide ring seal. It may optionally be replaced by a lip seal or any other embodiment of a sealing element.

The ventilating device of the annular chamber 7 is formed by two ventilating openings 8, 9 which are vertically on top of one another. They are slanting thus penetrating the wall of cover 2. Both openings 8, 9 end in a common radial plane in the annular chamber 7. At their opposing ends, two annular disks or rings 10 placed together proceed axially in direction toward the bearing 5. They have an annular configuration and are made of a needle-punched nonwoven consisting of polyester fibers. The rings 10 are adhesively incorporated in a liquid-impermeable cup-shaped carrier 11 made of plastic by which they are completely covered on the side facing axially radially toward the outside and on the side facing toward the bearing 5. The cup-shaped carrier 11 includes a tubular portion which is pressed into the receiving bore of cover 2 between the openings 8, 9 and the bearing 5, and an annular disk portion toward the bearing 5. The absorbent rings 10 are received radially inside of the tubular portion against the annular disk portion so that the rings 10 are exposed to the annular chamber. The external diameter of the tubular portion is dimensioned such that it is pressed into the receiving bore of cover 2, it is concentrically fixed therein. The internal diameter of the rings 10 is dimensioned such that there is a relatively moving surface contact or a gap which is capillary-active with respect to the shaft 4. During use, coolant passing through the sealing gap of the sealing element 6 is thus continuously fed to the porous structure of the disks 10 and temporarily stored therein. Due to the high temperature of the shaft 4 and the front face of the sealing element 6 facing toward the disks 10, any coolant stored in the disks is continuously evaporated. The coolant evaporating over the front surface of the disks is taken up by the air passing the annular chamber 7 through the ventilating openings 8, 9 and removed from the annular chamber 7 via opening 9. Liquid particles are thus kept away from the bearing 5 to a maximum possible extent with no traces of leakage seen in the area of the openings 8, 9 at the outer surface of the cover of the bearing. Yet, the axial length required is substantially reduced.

What is claimed is:

1. Cooling water pump for fixing to the pump housing of a combustion engine, comprising a bearing cover which can be fixed to the pump housing, said cover having a bore, a bearing fixed in said bore, a pump shaft rotatably mounted in said bearing cover by means of said bearing and having an impeller extending into said pump housing, a sealing element between the impeller and the bearing, an absorbent ring about said shaft axially between sealing element and said bearing defining an annular chamber axially between said absorbent ring and said sealing element, and ventilating openings penetrating said cover on opposite sides of shaft at said annular chamber whereby leaked coolant is drawn off through the opening prior to saturation of the absorbent ring and contamination of the bearing by foreign matter from outside cover is prevented.

2. Pump as in claim 1 wherein said ring is fixed relative to said cover.

3. Pump as in claim 1 wherein said ring is coaxial to said shaft.

4. Pump as in claim 1 further comprising means impermeable to liquid between said absorbent ring and said bearing.

5. Pump as in claim 4 wherein said impermeable means comprises a tubular portion and an annular disk portion, thereby having an L-shaped cross-section.

6. Pump as in claim 1 wherein at least one said opening is disposed above said shaft and at least one said opening is disposed below said shaft.

7. Pump as in claim 6 wherein the opening above said shaft is at the top of said annular chamber and the opening below said shaft is in the bottom of said annular chamber.

8. Pump as in claim 1 wherein said ring is shaped as an annular disk.

9. Pump as in claim 1 wherein said ring is made of an open pore foam.

10. Pump as in claim 1 wherein said ring is made of fibrous material.

11. Pump as in claim 10 wherein said fibrous material is impregnated with a water binding material.

12. Cooling water pump as in claim 1 further comprising a liquid impermeable cup-shaped carrier having a tubular portion which is fixed in the bore of the cover between the openings and the bearing, and an annular disk portion toward the bearing, said absorbent ring being received radially inside of the tubular portion so that the ring is exposed to the annular chamber and the pump shaft.

* * * * *